US006588160B1

(12) United States Patent
Grossman

(10) Patent No.: US 6,588,160 B1
(45) Date of Patent: Jul. 8, 2003

(54) COMPOSITE STRUCTURAL MEMBER WITH PRE-COMPRESSION ASSEMBLY

(76) Inventor: Stanley J. Grossman, 10408 Greenbriar Pl., Oklahoma City, OK (US) 73159

( * ) Notice: Subject to any disclaimer, the term of this patent is extended or adjusted under 35 U.S.C. 154(b) by 0 days.

(21) Appl. No.: 09/378,326

(22) Filed: Aug. 20, 1999

(51) Int. Cl.[7] ..... E04C 5/08

(52) U.S. Cl. ..... 52/223.7; 52/223.14; 52/584.1; 14/73; 14/73.1; 14/77.1; 404/56

(58) Field of Search ..... 14/73, 73.1, 77.1; 52/223.1, 223.6, 223.7, 223.14, 582.1, 584.1; 404/56

(56) References Cited

U.S. PATENT DOCUMENTS

| | | | | | |
|---|---|---|---|---|---|
| 4,493,177 | A | | 1/1985 | Grossman | |
| 4,646,493 | A | | 3/1987 | Grossman | |
| 4,700,516 | A | * | 10/1987 | Grossman | 52/223 |
| 4,972,537 | A | * | 11/1990 | Slaw, Sr. | 14/1 |
| 4,991,248 | A | * | 2/1991 | Allen | 14/73 |
| 5,144,710 | A | | 9/1992 | Grossman | |
| 5,301,483 | A | | 4/1994 | Grossman | |
| 5,305,575 | A | | 4/1994 | Grossman | |
| 5,339,475 | A | * | 8/1994 | Jaeger et al. | 14/73 |
| 5,553,439 | A | * | 9/1996 | Grossman | 52/745.2 |
| 5,820,299 | A | * | 10/1998 | Anderson | 405/172 |
| 5,978,997 | A | | 11/1999 | Grossman | |
| 6,050,038 | A | * | 4/2000 | Fey et al. | 52/223.7 |
| 6,170,209 | B1 | * | 1/2001 | Dagher et al. | 52/223.1 |

* cited by examiner

*Primary Examiner*—Lanna Mai
*Assistant Examiner*—Dennis L. Dorsey
(74) *Attorney, Agent, or Firm*—McAfee & Taft

(57) ABSTRACT

A composite structural member with pre-compression assembly. The apparatus comprises a plurality of longitudinally extending composite units. Each composite unit comprises a plurality of longitudinally extending girders or beams disposed on the bridge supports and a deck portion made of a moldable material and attached to the beams. Pre-compression is used for clamping adjacent units together such that a gap or hardened grout-filled joint between the deck portions thereof is substantially closed. The pre-compression portion of the apparatus includes a threaded member disposed through holes in facing beams of adjacent composite units with a fastener engaging the threaded member so that tightening of the fastener on the threaded member pulls the adjacent units together. The deck portions of the composite units may use a tongue-in-groove construction, and adhesive may be placed in the gap between the deck portions. The apparatus is particularly useful in repairing a bridge structure to replace an old concrete deck quickly while providing for minimal traffic interruption.

24 Claims, 6 Drawing Sheets

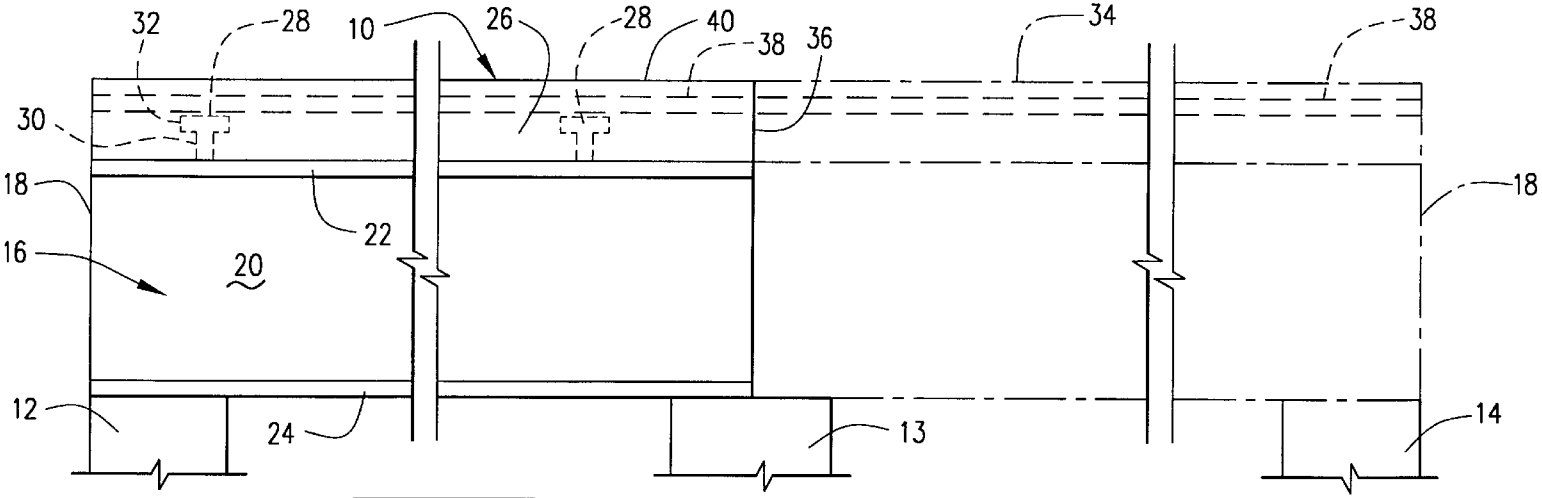
FIG. 1 - PRIOR ART
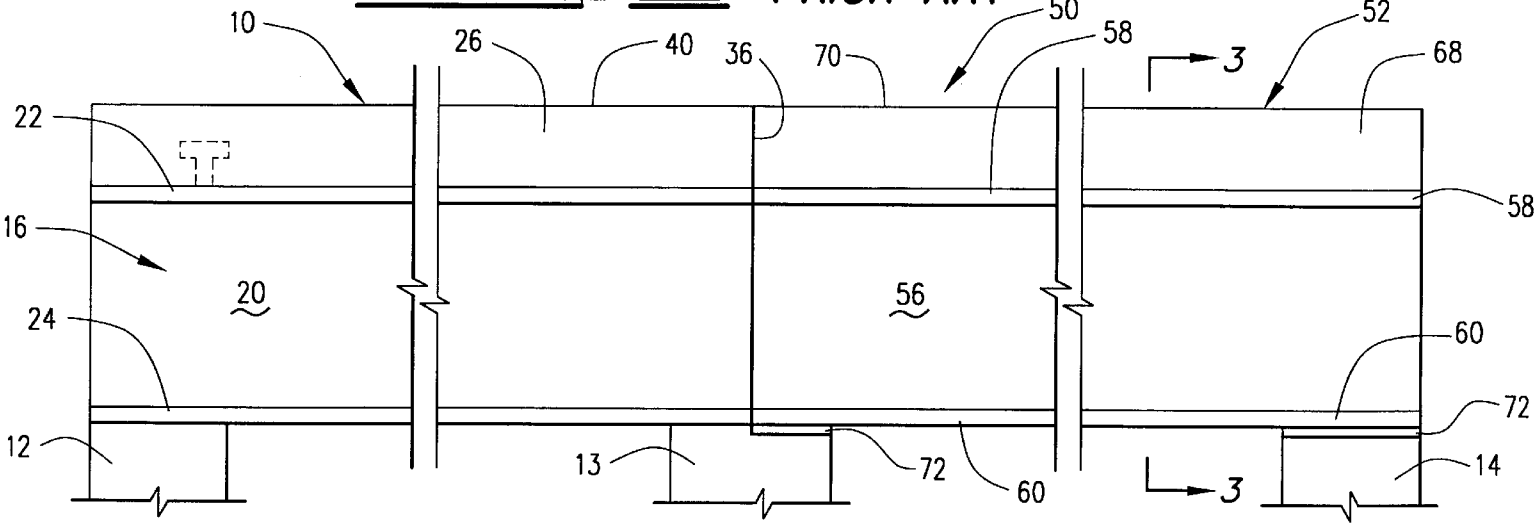
FIG. 2

COMPOSITE STRUCTURAL MEMBER WITH PRE-COMPRESSION ASSEMBLY

BACKGROUND OF THE INVENTION

1. Field of the Invention

This invention relates in general to pre-cast concrete and steel composite structural members, such as used in modular bridge structures, and more particularly, to modular composite structural members which use a pre-compression assembly for the joint during construction, refurbishing and/or widening.

2. Description of the Prior Art

Large structures, such as bridges are well known and are obviously time-consuming to build or widen and even more time-consuming to rehabilitate. Typically, a bridge structure will have longitudinally extending girders with a concrete deck surface. The concrete deck is made composite with the girders by pouring the concrete in place around shear connectors connected to the girders. The structure may be formed upside down and then inverted to place it in its final operating position. This latter specialized technique is disclosed in U.S. Pat. Nos. 4,493,177, 4,646,493, 4,700,516, 5,144,710, 5,301,483, 5,305,575 and 5,553,439, copies of which are incorporated herein by reference.

To form such composite members of the type having an upper concrete surface and a metal support underneath, a mold typically is utilized. First, the steel supports, such as girders or beams, are placed beneath a mold assembly having two or more mold pieces disposed around and supported by the supports. Next, the concrete is poured into the mold such that the concrete fills the mold and extends over the girders or beams. When the concrete is hardened, the mold pieces are disassembled from around the supports such that the concrete rests on the supports. In most instances, these types of structural members are formed in place. This is usually advantageous so the concrete deck surface can better fit into the finished structure. The concrete deck portion is attached to the beams by shear connectors which are molded into the concrete, or which extend into openings in the concrete, which are then grouted in place. This technique works satisfactorily in many cases, particularly in original bridge construction where the area of construction is readily accessible.

When separate prefabricated composite units are used, the sections are positioned adjacent to one another, and the metal support members in those sections, such as girders or beams, are then positioned on the piers or abutments. This technique is particularly useful when it is not feasible to form the entire structure in place or when the use of prefabricated members can save construction time on site. It also works well in bridge widening projects where prefabricated members are installed next to the existing structure.

Certain construction constraints, such as those in which a bridge structure is being repaired or otherwise refurbished or rehabilitated, make many prior art methods of construction more expensive and result in associated problems, such as traffic delays. In repair or refurbishing, typically the old concrete deck, or at least a part of it, is removed, and another deck must be put in its place. If the replacement deck must be poured in place, molds must be set up, the concrete poured, and then the concrete allowed time to cure before a bridge structure can be reopened to traffic. In high-density traffic areas, this creates considerable traffic tie-up problems, which result in significant lost time and inconvenience to commuters and other travelers.

The use of prefabricated composite units which can be set in place, such as those described above, greatly reduces the repair time involved. That is, the old structure may be removed, and the new structure simply set in place on the piers or abutments and attached to them. Because of the prefabrication, the time necessary to construct molds, pour concrete and allow the concrete to cure all can occur prior to the placement of the composite units. Thus, the"down time" to repair the bridge structure is greatly reduced, which lowers costs and pleases motorists. However, this technique creates longitudinal and transverse joints that need to be filled and which become potential pathways for water and salt-laden water to fall objectionably on other parts of the structure.

The present invention all but eliminates this objectionable leakage without adding construction time to a constrained time window, such as occurs in overnight construction, because the modular units can carry traffic before they are permanently clamped together. In the present invention, prefabricated composite units are still positioned adjacent to one another, but are also pulled and clamped together by a pre-compression assembly which holds all of the units together in place. The structure can make use of match-casting the abutting faces so the usual ¾ to ½ inch wide gap is narrowed. The joint may be filled with an adhesive applied to the abutting faces of the joint before they are pulled together. Whether used with match-cast, abutting faces or a conventional, hardened, grout-filled joint, pre-compressing the joint has the advantage of creating an extremely water-tight joint and, at the same time, supplementing the tensile resistance of the joint adhesive with pre-compressive stresses. In the event that tensile stresses are produced in the joint that exceed the pre-compression combined with the tensile strength of the joint adhesive, the size of the formed crack is limited to less than about 0.001 inches by the pre-stressed steel immediately beneath the joint.

One conventional approach to pre-compressing bridge structures is to install conduit in the deck portions thereof which is accomplished by positioning the conduit and pouring the moldable material around it. Steel cables are installed in these conduits after the bridge structure is erected and compression applied to the structure in a transverse direction by post-tensioning the steel cables. This process has several problems, one of which is the difficulty of aligning the conduits during the erection of the bridge structure. Further, there is a potential for damaging both the cable and its protective coating when the cable is pulled through misaligned conduits. Additionally, any such damage and consequent future deterioration is not visible which can lead to unexpected and sudden failure. In the present invention, any future deterioration of the pre-compression components is readily visible and much more easily corrected than with hidden and buried cable.

SUMMARY OF THE INVENTION

The present invention is a composite structural member, such as used in bridge construction. The member generally comprises a plurality of composite units, each unit itself comprising a plurality of longitudinally extending girders or floor beams disposed on bridge supports and a deck portion made of a moldable material and attached to the beams. The member further comprises pre-compression means for clamping adjacent units together such that a gap between the facing deck portions thereof is substantially closed and a joint formed therebetween is pre-compressed. The joint may be filled with a hardened high-strength grout.

In one preferred embodiment, one of the first and second transversely facing sides of at least one of the deck portions of the units defines a groove therein, and the other of the first and second transversely facing sides of at least one of the deck portions has a tongue portion thereon adapted for extending into the groove of an adjacent, facing deck portion such that upper surfaces of the adjacent deck portions are held substantially aligned and positioned coplanar. An adhesive may be disposed in the gap between the deck portions and in the groove.

Facing beams of adjacent units define holes therein which are substantially aligned, and the pre-compression means comprises a threaded member disposed through the holes on the facing beams and fastener means threadingly attached to the threaded member when tightened on the threaded member. In one embodiment, the threaded member is a bolt extending through one of the holes in one of the facing beams and one of the holes in the other of the facing beams, and the fastening means is characterized by a nut attached to the bolt.

A diaphragm connection plate is preferably attached to facing beams of adjacent units, and a diaphragm is attached to the adjacent diaphragm connection plates after the pre-compression means has been actuated to close the gap between the deck portions of the adjacent units. The diaphragm connection plate extends substantially transversely so that it is substantially perpendicular to the beams. A stiffener plate may be attached to the beam substantially parallel to the diaphragm connection plate, and thus, the stiffener plate preferably extends substantially transversely. The pre-compression is preferably disposed between the diaphragm connection plate and the stiffener plate.

The composite units may be prefabricated in an inverted position prior to being positioned on the supports, although the invention is not intended to be limited to this type of construction.

In an alternate embodiment, the invention may be described as a structural member for use on a structural support adjacent to an existing structure in which the structural member comprises a composite unit, a clamping member, attaching means for attaching the clamping member to the existing structure, and pre-compression means for clamping the composite unit against the existing structure after the clamping member is attached thereto such that a gap between deck portions of the composite unit and the existing structure is substantially closed and the joint formed therebetween is pre-compressed in a direction substantially perpendicular to the beams. The joint may be grout-filled. The composite unit comprises a plurality of substantially parallel beams adapted for positioning on the structural support, and a deck support made of a moldable material attached to the beams.

In a situation where the existing structure includes similar composite units, the clamping member may be characterized by one of the beams of such composite units. In this case, the structure and assembly thereof are similar to that previously described.

However, when the existing structure does not lend itself to the previously described attachment, such as when the existing structure has a concrete girder, the clamping member may be characterized by an angled member attached to a lower surface of the deck portion-of the existing structure.

The clamping member preferably defines one or more holes therein which are aligned with holes in a facing beam of a composite unit. The pre-compression means comprises a threaded member disposed through the holes in said clamping member and said facing beam, and fastener means threadingly attached to the threaded member thereon for pulling the clamping member and facing beam toward one another when tightened on the threaded member.

The present invention also includes a method of repairing a bridge structure comprising the steps of (a) prefabricating a plurality of composite units, each composite unit comprising a plurality of substantially parallel beams and a deck portion made of a moldable material and attached to the beams, (b) removing an old deck portion and girder portion therebelow of the bridge from an area above the bridge supports, (c) positioning at least some of the composite units in the area to replace the old deck and girder portions such that the beams in the units extend substantially longitudinally and (d) clamping facing beams on adjacent units together in a transverse direction so that a gap defined between facing unit deck portions of the adjacent composite units is substantially closed.

Step (a) preferably comprises prefabricating the units such that an overall height thereof is no greater than a height of the old bridge portion. The method may further comprise, prior to step (d), positioning shims between the beams and supports such that upper surfaces of the unit deck portions are substantially coplanar with an upper surface of the old deck portion.

Step (a) may comprise prefabricating the units in an inverted position.

Step (a) may also comprise forming at least some of the unit deck portions such that the deck portion has a first transversely facing side defining a groove therein and a second transversely facing side having a tongue portion thereon adapted for extending into the groove of an adjacent unit deck portion after step (d) such that upper surfaces of the adjacent deck portions are substantially aligned and held coplanar. The method may further comprise, prior to step (d), placing an adhesive in the gap and/or in the groove so a substantially watertight seal is formed.

In the preferred embodiment, step (d) comprises positioning a threaded member through aligned holes in the facing beams of the adjacent units, attaching a fastener to the threaded member, and tightening the fastener on the threaded member and thereby pulling the facing beams toward one another. The threaded member may be a bolt, and the fastener may comprise a nut attached to the bolt.

The method may further comprise the steps of (e) attaching a transversely extending diaphragm-connection plate to each of the facing beams, and (f) attaching, after step (d) a diaphragm to adjacent diaphragm connection plates on the facing beams to connect the beams together. Step (e) may be part of step (a). The bolts and nuts may be subsequently removed. Alternatively, the diaphragm may be omitted and the bolts and nuts left in place, in which case the pre-compressed ends of the deck portions also function as a diaphragm. In this latter case, the diaphragm connection plate is preferably replaced with a stiffener plate.

The present invention also includes methods of widening a bridge structure. One of these is a method of widening a bridge having an existing beam thereon comprising the steps of (a) prefabricating a composite unit comprising a plurality of substantially parallel unit beams, and a unit deck portion made of a moldable material and attached to the unit beams, (b) positioning the unit adjacent to an old section of the bridge structure such that the unit beams extend longitudinally with respect to the bridge structure and one of the unit beams is a facing unit beam with respect to the existing beams, and (c) clamping the facing beam and existing beam together such that a joint formed between a side of the bridge structure and a facing unit deck portion is pre-compressed.

Step (a) preferably comprises prefabricating the units in an inverted position.

This method of widening a bridge may further comprise, prior to step (c), placing a hardenable grout in the joint.

Step (c) comprises forming a plurality of holes in the existing beam corresponding to a plurality of holes defined in the facing beam, positioning a threaded member through aligned holes in the existing beam and the facing beam, attaching a fastener to the threaded member, and tightening the fastener on the threaded member such that the existing beam and facing beam are biased toward one another.

For widening a bridge structure which does not have an existing metal beam, the method may be described as one comprising the steps of (a) prefabricating a composite unit comprising a plurality of substantially parallel unit beams, and a unit deck portion made of a moldable material and attached to the unit beams, (b) positioning the unit adjacent to an old section of the bridge structure such that the unit beams extend longitudinally with respect to the bridge, (c) attaching a clamping member to a lower surface of the bridge adjacent to a side thereof, and (d) clamping the clamping member to a facing unit beam on the composite unit together such that a joint formed between the side of the bridge and a facing unit deck portion is pre-compressed. Step (a) preferably comprises prefabricating the units in an inverted position.

This other widening method may further comprise, prior to step (d), placing a hardenable grout in the joint.

Step (d) comprises positioning a threaded member through aligned holes in the facing beam and the clamping member, attaching a fastener to the threaded member, and tightening the fastener on the threaded member such that the facing beam and clamping member are biased toward one another.

The methods of widening may also comprise, prior to the step of pre-compressing, positioning shims between the beams and supports such that an upper surface of the unit deck portion is substantially coplanar with an upper surface of the old bridge section.

In the preferred embodiment of the member, the clamping member is attached to the lower surface of the deck portion of the old bridge section using a plurality of anchor bolt assemblies.

Numerous objects and advantages of the invention will become apparent as the following detailed description of the preferred embodiment is read in conjunction with the drawings illustrating such embodiment.

BRIEF DESCRIPTION OF THE DRAWINGS

FIG. 1 illustrates a prior art bridge structure having a portion thereof removed so that a refurbishing section may be installed.

FIG. 2 shows the prior art bridge structure of FIG. 1 in which the composite structural member with pre-compression assembly of the present invention is installed as a refurbishing section.

FIG. 6 illustrates an alternate embodiment.

DESCRIPTION OF THE PREFERRED EMBODIMENT

Figure 3:
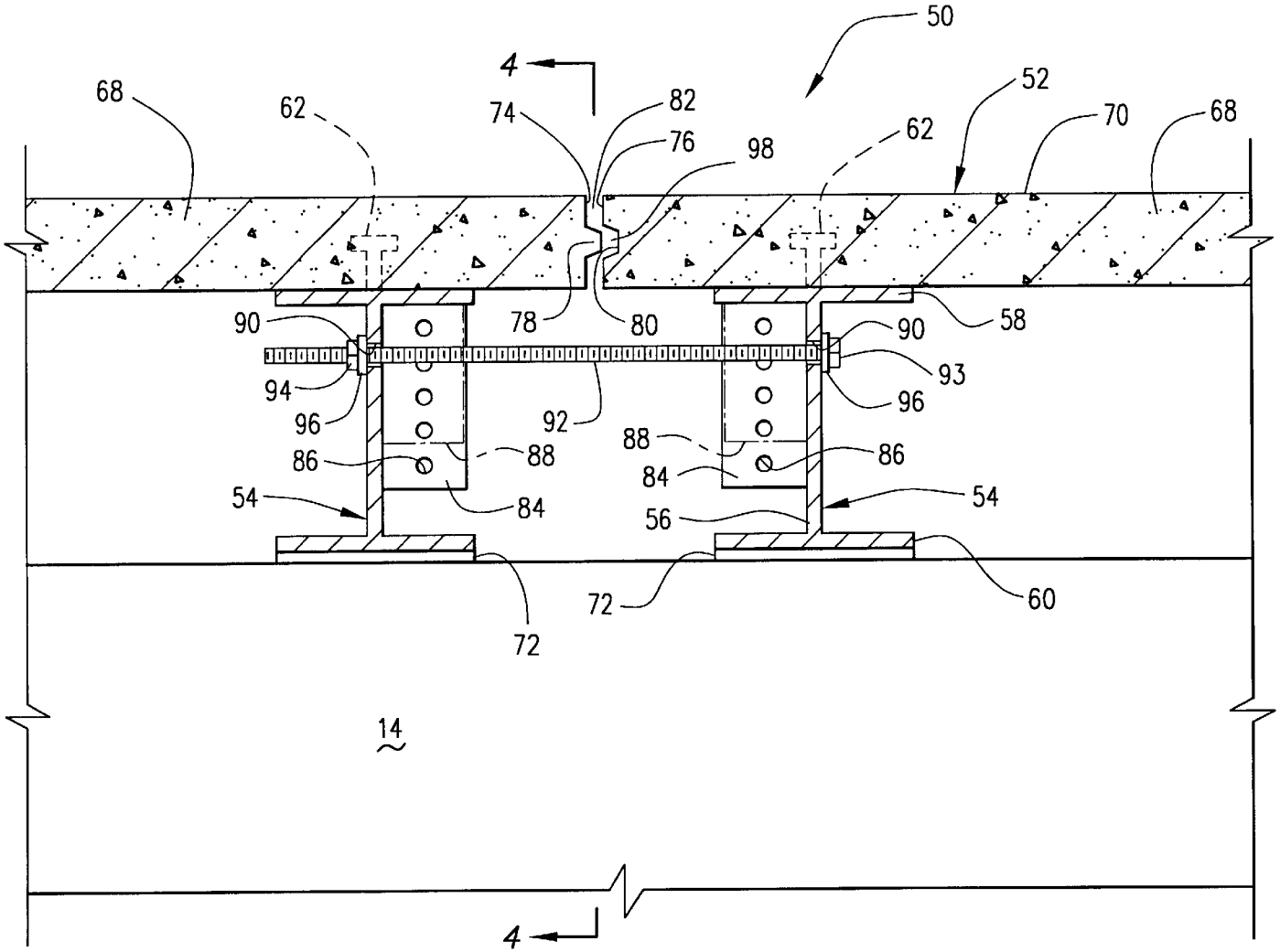
FIG. 3 is a cross section taken along lines 3—3 in FIG. 2.

The present invention relates to composite structures, such as bridges and is adapted for use in new construction, refurbishment of old structures, and widening of existing structures. The refurbishment of an existing structure is described first.

Referring initially to FIG. 1, a prior art composite structure in the form of a bridge is shown and generally designated by the numeral 10. This prior art bridge is adapted for extending between a pair of supports 12, 13 and 14. Of course, additional supports may be provided in a typical bridge.

Bridge 10 comprises a plurality of longitudinally extending girders 16, which generally have an I-beam configuration. Girders 16 are positioned and supported on structural supports 12 and 14, such as abutments, adjacent to longitudinally opposite ends 18 of the girders and on structural supports 13, such as piers. Each girder 16 has a vertically extending central portion 20 with horizontal upper and lower flange portions 22 and 24.

Disposed above girder 16 is a molded deck portion 26, which is made of a moldable material, such as concrete. Extending upwardly from the top of girder 16 is a plurality of shear connectors 28. Shear connectors 28 are fixedly attached to the top of upper flanges 22 of girder 16. Each shear connector 28 preferably has a shank portion 30 with an enlarged head portion 32 at the outer end thereof. Other kinds of connectors are also generally known. Deck portion 26 is formed and placed on girders 16 such that the molded material forming the deck portion is molded around shear connectors 28, thus forming a locking attachment between deck portion 26 and girder 16. Once the molded material has hardened, a composite structure is formed.

Using prior techniques, when it is time to repair or refurbish prior art bridge 10, the area of deck portion 26, which is to be replaced, is removed. Of notable difficulty in this regard is the removal of concrete from around shear connectors 28. For example, in FIG. 1, a section 34 is shown in phantom lines as having been removed. This will usually necessitate cutting through the concrete such that another end surface 36 is formed on the remaining part of the deck portion.

If section 34 is to be replaced by conventional methods, a mold (not shown) must be formed in the area where old section 34 was and the mold filled with new hardenable material. The material must harden so that a new composite structure is formed. During this process, it will be necessary to reposition new reinforcing material 38 so that it will also be integral with the final structure within the concrete. All of this is a very time-consuming process, and results in the portion of the bridge being repaired or refurbished being out of commission for traffic for a significant period of time including while the concrete cures. In some locations, this simply creates too large a burden on traffic flow to be acceptable. Also, in this process, some or all of shear connectors 28 in the area to be repaired or refurbished may be inadvertently removed or damaged such that subsequent removal is necessary. This requires that new shear connectors 28 be attached which, again, undesirably increases the time the bridge is out of use.

A modular system is shown in U.S. Pat. Nos. 4,493,177 and 4,646,493. The modular construction shown in these patents may be utilized in repairing or also widening a bridge structure without the necessity of positioning new molds and pouring new concrete in place. When these modular units are used, the entire section of prior art bridge 10, which is to be replaced, is removed, thus reducing the difficulty and time for the removal step. That is, a section of deck portion 26 is removed, but also the portion of girder 16 thereunder is removed. Again, this is shown in FIG. 1 in phantom lines.

With such modular units, each of which has a deck portion attached to a plurality of longitudinally extending girders or floor beams, the units may be positioned on top of supports 12, 13 and/or 14 as required after the original section bridge structure 10 has been removed. As further discussed herein, appropriate shims are placed between the girders and the supports so that the upper surface of the molded deck portions of the modules is flush and coplanar with the upper surface of the molded deck portion on the original structure. Grouting material can be placed between the ends of the adjacent modules as necessary. Such modules are easily and quickly positioned on the supports so that the amount of time that the bridge is out of use is greatly reduced from the older, more conventional method of pouring in place. However, because the modules are not originally interconnected, they must eventually be attached to one another. Since the modules are capable of temporarily supporting traffic without such attachment, traffic can be placed on the unconnected modules for short periods of time until the attachment can be made.

Referring now to FIGS. 2 and 3, the composite structural member with pre-compression assembly of the present invention is shown and generally designated by the numeral 50. As will be further seen herein, the present invention provides for quick, temporary attachment so that traffic on the unconnected modules, if necessary, will only be for a short period of time.

When a portion of the old structure is removed as previously described, one or more composite units 52 are positioned in the cleared area as seen in FIGS. 2 and 3. Each composite unit 52 comprises a plurality of longitudinally extending unit beams 54, which extend substantially the entire length of each composite unit 52. Beams 54 are preferably of I-beam construction having a substantially vertical central web portion 56 with upper and lower flanges 58 and 60.

Extending from the top of each longitudinal beam 54 is a plurality of shear connectors 62. Shear connectors 62 are fixedly attached to upper flange 58 of beams 54. Each shear connector 62 has a shank portion 64 with an enlarged head portion 66 at the outer end thereof, but other kinds of connectors generally known in the art may also be used.

Each composite unit 52 further comprises a molded unit deck portion 68. Deck 68 is made of concrete or similar material and is molded around shear connectors 62 on upper flanges 58 of beams 54 to form a composite structure after the concrete hardens. Preferably, but not by way of limitation, deck 68 is molded such that it is prestressed in a manner wherein upper surface 70 of the deck is placed in compression at least in the direction of longitudinal beams 54 when in the operating position shown in the drawings.

One method of forming composite units 52 is that described in U.S. Pat. Nos. 4,493,177 and 4,646,493, previously mentioned. Using this method, each composite unit 52 is constructed in an inverted position such that beams 54 and the mold for forming deck 68 may have downward deflection. The mold is filled with the moldable material, such as concrete, which hardens to form a composite structural member with beams 54. During placing of the moldable material, the mold is deflected so that beams 54 are placed in a stressed condition to form a composite, pre-stressed structural member upon hardening of the moldable material. Once hardening has occurred, the unit is inverted. When so inverted and supported at the outer ends of beams 54, the center portion of the structure will be free to deflect downwardly due to its own weight so that the hardenable material is substantially always in compression in the direction of longitudinal beams 54, and its bottom flange is always in tension. Thus, the resulting composite units have been beneficially pre-stressed since deck 68 thereby resists cracking and the bottom flange tension in beams 54 is reduced by the opposite stresses placed on these beams in the molding process.

Regardless of the actual molding process for forming composite units 52, these composite units are positioned on supports 12, 13 and/or 14 initially as shown in FIGS. 2 and 3. The overall height of each composite unit 52 is slightly less than the overall height or thickness of original portion of the old bridge structure 10. Shims 72 are placed as necessary between lower flanges 60 of each beam 54 and supports 12, 13 and/or 14 such that upper surface 70 of deck portion 68 of composite units 52 is substantially coplanar and flush with upper surface 40 on the remaining part of original deck portion 26.

A first longitudinally extending face or side 74 of deck portion 68 of one composite unit 52 faces a second longitudinally extending face or side 76 of a deck portion 68 of an adjacent composite unit 52. Preferably, first side 74 has a tongue extending outwardly therefrom along the length of side 74 which is adapted for engagement in a corresponding groove 80 extending along the length of second side 76.

When adjacent composite units 52 are initially positioned on supports 12, 13 and/or 14, a longitudinally extending gap 82 is left between facing sides 74 and 76 thereof.

In FIG. 3, a diaphragm connection plate 84 is attached to an outer side of vertical portion 56 of each opposing beam 54 and to the underside of upper flange 58 of that beam, such as by welding. Each diaphragm connection plate 84 defines a plurality of holes 86 therein, which are arranged in a substantially vertical pattern.

Figure 4:
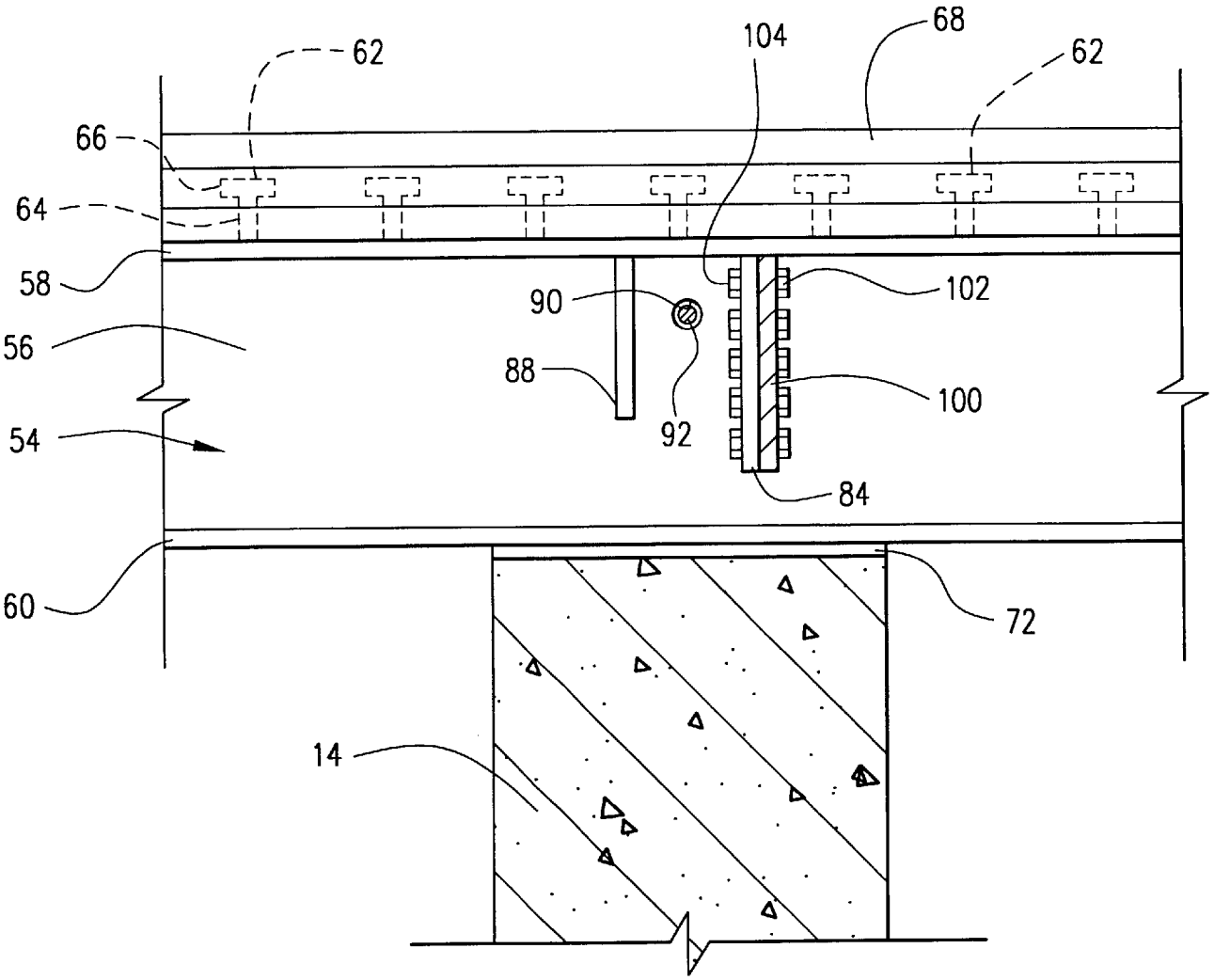
FIG. 4 shows a cross section taken along lines 4—4 in FIG. 3.

A stiffener plate 88 is similarly attached to each opposing beam 54 and transversely spaced from diaphragm connection plate 84, as best seen in FIG. 4. In FIG. 3, stiffener plate 88 is shown in phantom lines for clarity of illustration of diaphragm connection plate 84.

Still referring to FIG. 4, a hole 90 is formed through web portion 56 of opposing beams 54 of each composite unit 52. Hole 90 is longitudinally located between diaphragm connection plate 84 and stiffener plate 88. A plurality of such holes may be positioned along the length of beams 54 with corresponding diaphragm connection plates 84 and stiffener plates 88. Each of holes 90 is aligned with a corresponding hole 90 in a facing beam 54 in an adjacent composite unit 52.

Referring again to FIG. 3, a threaded bolt 92 is positioned through corresponding holes 90 on facing beams 54 of adjacent composite units 52 such that a head 93 of the bolt engages a web portion 56 of one of facing beams 54. A nut 94 is threaded onto the end of bolt 92 so that it engages web portion 56 of the other beam 54. Washers 96 may be placed between head 93 and nut 94 and web portions 56 of beams 54 as necessary.

In repairing old bridge structure 10, deck portion 26 and girder 16 therebelow of the section to be replaced are removed as previously described. Composite units 52 are placed on supports 12, 13 and/or 14 as previously described with a gap 82 defined between adjacent composite units.

Shims 72 are used as necessary to insure that upper surface 70 of composite units 52 is substantially flush and coplanar with upper surface 40 of the old deck structure 26.

In the illustrated embodiment, the faces 74 and 76 of units 52 are coated with an adhesive 98. Before adhesive 98 sets, nuts 94 on bolts 92 are tightened so that the adjacent composite structures 52 are pulled toward one another. Eventually, the structure reaches the final position shown in FIG. 5 in which adhesive 98 is compressed between first face 74 and second face 76 of the adjacent composite units 52 and tongue 78 extends into groove 80. Any extruded adhesive 98 is simply removed after this operation.

This clamping of adjacent composite units 52, along with the tongue-and-groove engagement of the adjacent units with adhesive 98 therebetween will be seen to provide a substantially watertight seal between the adjacent units. In this way, water, and particularly salt-laden water, are prevented from draining down onto the metal components below deck portion 68. Of course, this will greatly reduce deterioration and extend the life of these metal components.

While not quite as effective as the tongue-and-groove joint, clamping a conventionally hardened grout-filled joint will also provide a substantially watertight seal between the adjacent units.

It also will be seen that bolts 92 and nuts 94 thus act to structurally interconnect adjacent composite units 52. While this arrangement, as well as one without the bolts and nuts, can support traffic temporarily, the installation of permanent diaphragms 100 provides more effective load transfer between units 52 and locks the tensioning into installed diaphragms 100, thereby allowing removal of tensioning bolts 92 and nuts 94.

This permanent attachment of adjacent composite structures 52 is accomplished by attaching a diaphragm 100 to each facing pair of diaphragm connector plates 84. A fastener of a kind known in the art, such as bolts 102 and nuts 104 are used to attach diaphragm 100 to diaphragm connection plates 84. Once this connection has been made, nuts 94 may be removed from bolts 92 and the bolts removed from holes 90 in web portion 56 of beams 54 if desired.

It should be noted, however, that alternatively an additional stiffener plate 88 may be used in lieu of diaphragm connection plate 84, in which case the tightened bolts 92 and nuts 94 remain part of the completed structure. In this case, diaphragm 100 is not necessary since the pre-compressed deck portions can also function as a diaphragm.

Composite units 52 are thus easily positioned in an open area on supports 12, 13 and/or 14 to replace the previously removed old bridge deck portion. The application of adhesive 98 and the tightening of nuts 94 on bolts 92 to clamp adjacent composite units 52 together can be done very quickly. It is envisaged that an old portion of bridge structure 10 may be removed and composite units 52 positioned to replace it during light traffic hours, such as at night, and then the bridge reopened as fully operational during the next peak traffic period. By replacing a relatively small portion each day, an entire bridge structure may be replaced quickly and efficiently with minimal interruption of traffic.

While the above description of the invention has been presented in the context of refurbishing an existing structure, those skilled in the art will see that this technique is virtually identical for new construction. That is, composite units 52 may be positioned in new construction as previously described and attached in the same way. The invention is not intended to be limited to a refurbishment situation.

Figure 5:
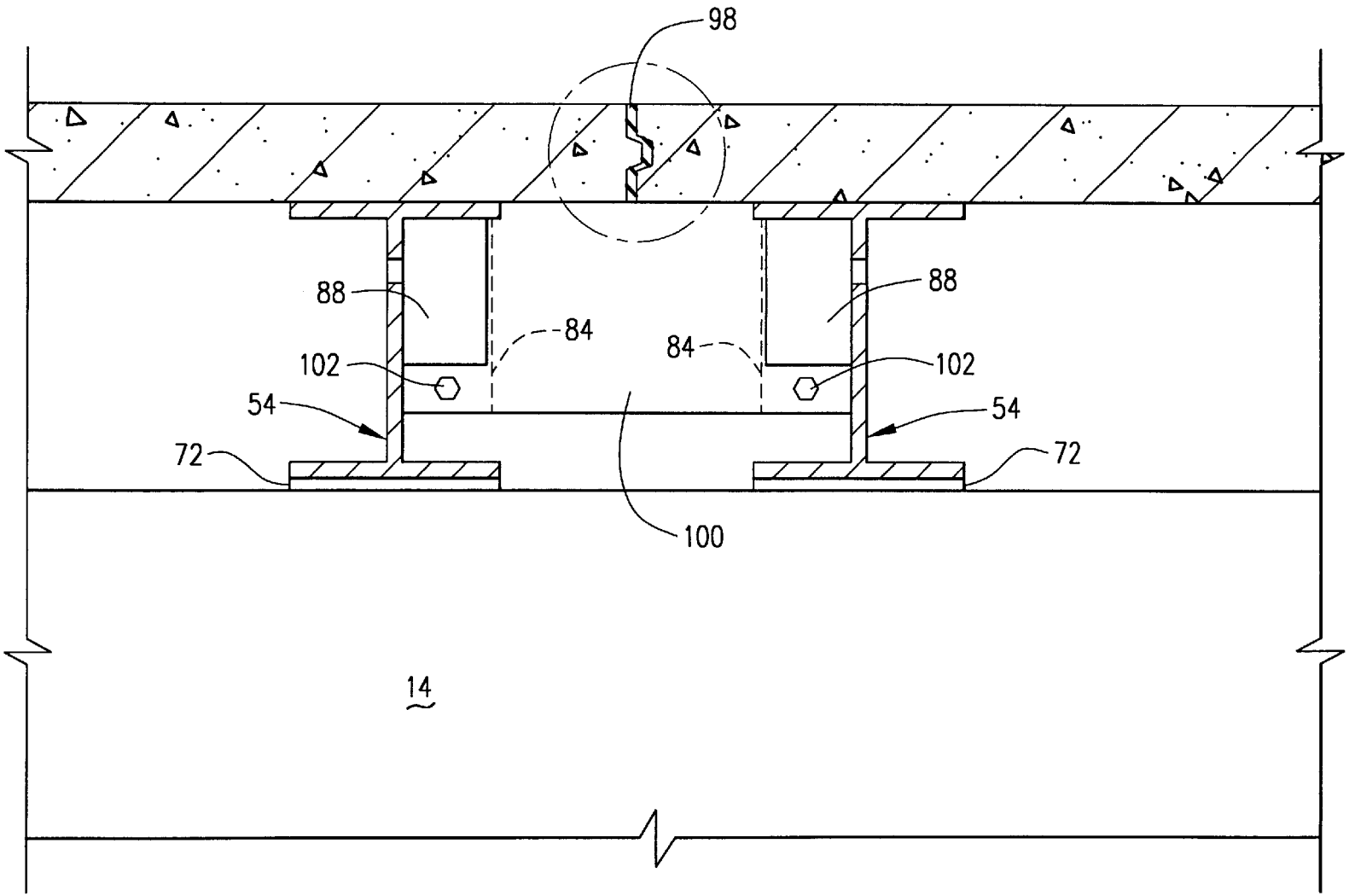
FIG. 5 shows a cross section similar to FIG. 3 but showing the structure in a final position with a diaphragm connecting the adjacent members.

Regardless of whether it is new construction or refurbishment, it will be seen that the tongue-and-groove arrangement shown in FIGS. 3 and 5 will form a pre-compressed joint when clamped together as described. The parts of deck portions 68 which cantilever from beams 54 form a hinge with zero moment at the center when the structure is completed.

Figure 5A:
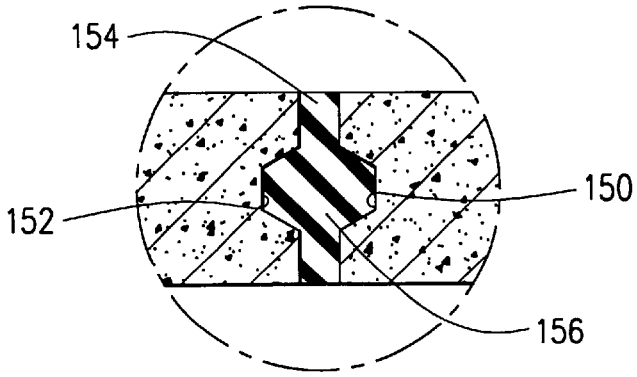
FIGS. 5A–5C illustrate alternate joint configurations.
Figure 5B:
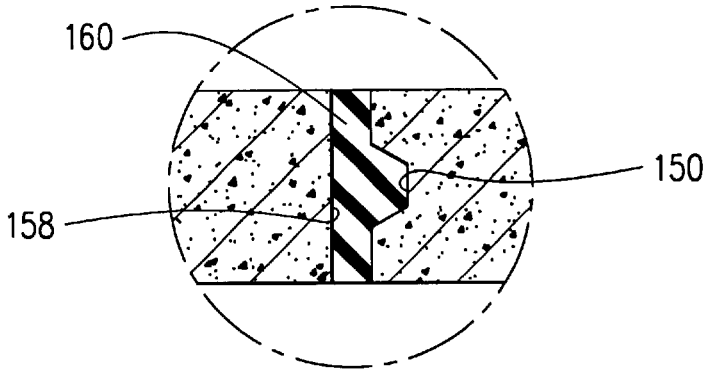
Figure 5C:
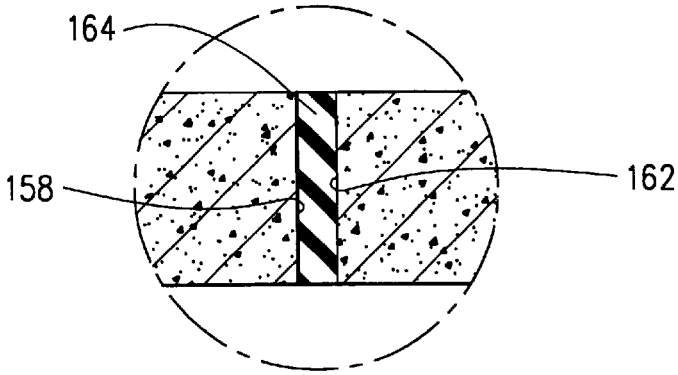
Figure 5:
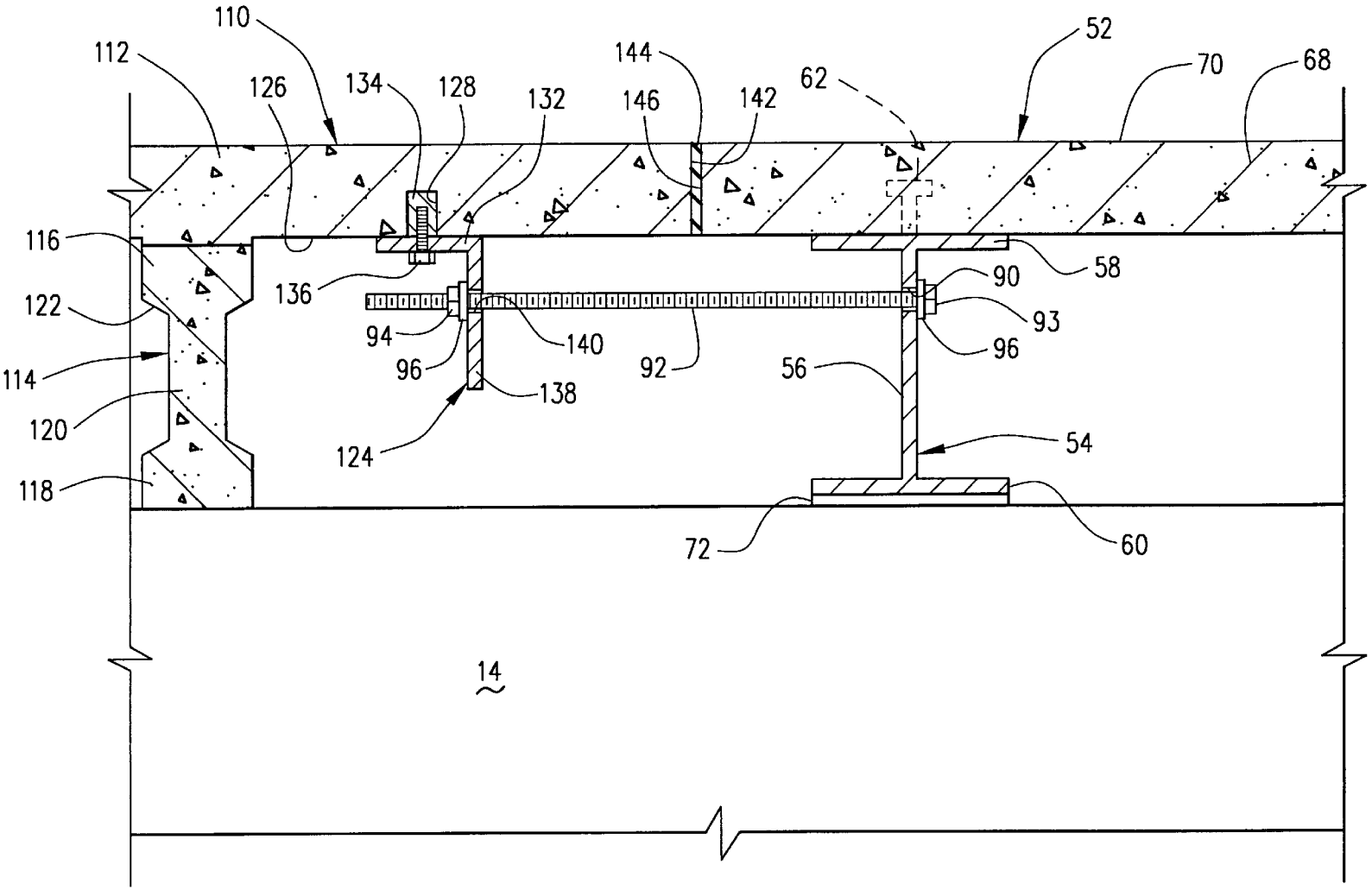

FIGS. 5A, 5B and 5C illustrate alternate joints. In FIG. 5A, facing grooves 150 and 152 are formed in the adjacent deck structures. The joint is filled with a hard grout 154. An enlarged center portion 156 of grout 154 fills grooves 150 and 152, and it will be seen by those skilled in the art that, after grout 154 hardens, this provides a strong hinge connection when pre-compressed. FIG. 5B illustrates an embodiment with a single groove 150 facing a flat side 158 of an adjacent deck, with the joint filled with grout 160. FIG. 5C illustrates a joint with two flat sides 158 and 160 with grout 164 disposed therebetween. The joints shown in FIGS. 5B and 5C will not be as strong as that shown in FIG. 5A, but with proper pre-compression applied as described herein, these joints can be adequate in situations where it is not practical to have two grooves or a tongue-and-groove configuration.

A specific example in which the joints shown in FIGS. 5B and 5C are necessary is one in which an existing structure is being widened. For widening a bridge structure having beams the same or similar to beams 54, a new composite unit 52 may be positioned adjacent to the outer side of the existing bridge structure and attached thereto in the manner previously described. Typically, the existing bridge structure will have a more or less flat side. It is generally not practical to try to cut a groove into such an existing structure while it is in place, so the joints shown in FIGS. 5B or 5C would be used.

Referring now to FIG. 6, another embodiment of the invention is shown. FIG. 6 also illustrates a situation in which an existing bridge structure and roadway are to be widened. Depending upon the construction of the prior existing structure, it may not be possible to connect the new modular bridge portion to it in the same manner as previously described herein. For example, FIG. 6 illustrates a prior structure 110 having an upper deck portion 112 supported on pre-stressed concrete girders 114. For those skilled in the art, it will be clear from a comparison of FIGS. 3 and 6, that a bolt cannot be easily run through concrete girder 114 in the same manner as steel beams 54. A typical concrete girder 114 has a cross section with a thick upper portion 116, and a thick lower portion 118 interconnected by a relatively thinner center portion 120. An angled surface 122 extends between the thick portions and the thin portions. This angled surface prevents proper engagement of a nut attached to a bolt in the manner described in the other embodiments.

To overcome this problem, a clamping member 124 is attached to lower surface 126 of deck portion 112. Clamping member 124 is illustrated as an angled member, but the invention is not intended to be limited to this particular shape. A series of holes 128 are drilled in lower surface 126 in alignment with a corresponding plurality of holes 130 in a horizontal first flange 132 of clamping member 124. A threaded anchor bolt 136 of a kind known in the art is disposed in each hole 128. Anchor bolt 136 is positioned through each hole 130 and engaged by an expansion mechanism 134 or epoxy to rigidly attach clamping member 124 to deck portion 112.

A vertical second flange 138 of clamping member 124 has one or more holes 140 defined therein which are substantially aligned with holes 90 in the opposing beam 54 of composite unit 52 which is installed adjacent to structure 110. The new composite unit 52 is attached to existing structure 110 by bolts 92 and nuts 94, along with washers 96, as previously described for the other embodiments. Prior to positioning composite unit 52, end face 142 on existing structure 110 may be ground smooth as necessary. The joint between face 142 on existing roadway 110 and face 146 on new composite unit 52 has high-strength grout 144 placed therebetween to obtain the same benefits as described herein for the other embodiments.

In the alternate embodiment shown in FIG. 6, the widening of an existing structure 110 is shown as previously described. In this case, where clamping member 124 is necessary because of the use of concrete girders 114, bolts 92 and nuts 94 are left in place to keep the structure tightly clamped together.

It will be seen, therefore, that the composite structural member with pre-compression assembly of the present invention is well adapted to carry out the ends and advantages mentioned as well as those inherent therein. While presently preferred embodiments of the structure and method of use have been shown for the purposes of this disclosure, numerous changes may be made in the arrangement and construction of parts in the structure and in the steps of the method of assembling the structure. All such changes are encompassed within the scope and spirit of the appended claims.

What is claimed is:

1. A structural member for use on a structural support, said member comprising:

a plurality of composite units, each unit comprising:

a plurality of substantially parallel beams adapted for positioning on the structural support; and a deck portion made of a moldable material and attached to said beams;

wherein, adjacent units have beams facing one another;

pre-compression means for clamping adjacent units together such that a joint formed between the deck portions thereof is pre-compressed;

a diaphragm connection plate attached to the facing beams of adjacent units; and a diaphragm adapted for attachment to adjacent diaphragm connection plates after said pre-compression means has been actuated.

2. The member of claim 1 wherein said diaphragm connection plate extends substantially transversely with respect to said beams.

3. The member of claim 1 further comprising a stiffener plate attached to said facing beams substantially parallel to said diaphragm connection plate.

4. The member of claim 3 wherein said stiffener plate extends substantially transversely with respect to said beams.

5. The member of claim 3 wherein said pre-compression means is disposed between said diaphragm connection plate and said stiffener plate.

6. A structural member for use on a structural support, said member comprising:

a plurality of composite units, each unit comprising:

a plurality of substantially parallel beams adapted for positioning on the structural support; and a deck portion made of a moldable material and attached to said beams;

pre-compression means for clamping adjacent units together such that a joint formed between the deck portions thereof is pre-compressed; and at least one stiffener plate attached to at least one of said beams.

7. The member of claim 6 wherein said stiffener plate extends substantially transversely with respect to said beams.

8. The member of claim 6 wherein said pre-compression means is disposed between a pair of said stiffener plates.

9. A structural member for use on a structural support, said member comprising:

a plurality of composite units, each unit comprising:

a plurality of substantially parallel beams adapted for positioning on the structural support; and a deck portion made of a moldable material attached to said beams;

wherein, adjacent units have beams facing one another;

pre-compression means for clamping adjacent units together such that a gap between the deck portions thereof is substantially closed and pre-compression is applied to said deck portions in a direction substantially perpendicular to said beams;

a diaphragm connection plate attached to the facing beams of adjacent units; and a diaphragm adapted for attachment to adjacent diaphragm connection plates after said pre-compression means has been actuated.

10. The member of claim 9 wherein said diaphragm connection plate extends substantially transversely with respect to said beams.

11. The member of claim 9 further comprising a stiffener plate attached to said facing beams substantially parallel to said diaphragm connection plate.

12. The member of claim 11 wherein said stiffener plate extends substantially transversely with respect to said beams.

13. The member of claim 11 wherein said pre-compression means is disposed between said diaphragm connection plate and said stiffener plate.

14. A structural member for use on a structural support, said member comprising:

a plurality of composite units, each unit comprising:

a plurality of substantially parallel beams adapted for positioning on the structural support; and a deck portion made of a moldable material attached to said beams;

pre-compression means for clamping adjacent units together such that a gap between the deck portions thereof is substantially closed and pre-compression is applied to said deck portions in a direction substantially perpendicular to said beams; and at least one stiffener plate attached to at least one of said beams.

15. The member of claim 14 wherein said stiffener plate extends substantially transversely with respect to said beams.

16. The member of claim 14 wherein said pre-compression means is disposed between a pair of said stiffener plates.

17. A structural member for extending longitudinally between structural supports, said member comprising:

a plurality of composite units, each unit comprising:

a plurality of longitudinally extending beams adapted for positioning on the structural supports; and a deck portion made of a moldable material and attached to said beams;

wherein, adjacent units have beams facing one another;

pre-compression means for clamping adjacent units together such that a gap between the deck portions thereof is substantially closed and pre-compression is applied to said deck portions in a substantially transverse direction; and a transversely extending diaphragm connection plate attached to the facing beams of adjacent units; and a diaphragm adapted for attachment to adjacent diaphragm connection plates after said pre-compression means has been actuated.

18. The member of claim 17 wherein said diaphragm connection plate extends substantially transversely.

19. The member of claim 17 further comprising a stiffener plate attached to said facing beams substantially parallel to said diaphragm plate.

20. The member of claim 19 wherein said stiffener plate extends substantially transversely.

21. The member of claim 19 wherein said pre-compression means is disposed between said diaphragm connection plate and said stiffener plate.

22. A structural member for extending longitudinally between structural supports, said member comprising:

a plurality of composite units, each unit comprising:

a plurality of longitudinally extending beams adapted for positioning on the structural supports; and a deck portion made of a moldable material and attached to said beams;

pre-compression means for clamping adjacent units together such that a gap between the deck portions thereof is substantially closed and pre-compression is applied to said deck portions in a substantially transverse direction; and at least one stiffener plate attached to at least one of said beams.

23. The member of claim 22 wherein said stiffener plate extends substantially transversely.

24. The member of claim 22 wherein said pre-compression means is disposed between a pair of said stiffener plates.

* * * * *